United States Patent [19]

Werbowy et al.

[11] Patent Number: 4,596,737

[45] Date of Patent: Jun. 24, 1986

[54] METHOD FOR THE TREATMENT AND PRODUCTION OF GLASS FIBER MATS

[75] Inventors: Kenneth D. Werbowy, Islington, Canada; Frederick A. Gill, Littleton, Colo.

[73] Assignee: Manville Corporation, Denver, Colo.

[21] Appl. No.: 758,175

[22] Filed: Jul. 23, 1985

[51] Int. Cl.[4] ..... B32B 17/02; B27N 3/00

[52] U.S. Cl. ..... 428/228; 156/62.2; 427/389.8; 428/268; 428/273

[58] Field of Search ..... 427/389.8; 156/62.2; 428/228, 268, 273

[56] References Cited

U.S. PATENT DOCUMENTS

| | | | |
|---|---|---|---|
| 2,922,472 | 11/1975 | Foley et al. | 428/429 |
| 3,616,179 | 10/1971 | McCombs et al. | 156/62.4 X |
| 3,616,181 | 10/1971 | Stalego | 156/167 X |
| 3,846,225 | 11/1974 | Stalego | 156/62.2 |
| 4,014,726 | 3/1977 | Fargo | 156/167 |
| 4,014,835 | 3/1977 | McCombs | 428/378 X |
| 4,060,658 | 11/1977 | Lin et al. | 428/378 |
| 4,064,359 | 12/1977 | Peterson et al. | 428/228 |
| 4,122,074 | 10/1978 | Pepe et al. | 526/26 |
| 4,126,729 | 11/1978 | Richardson | 428/389 |
| 4,163,073 | 7/1979 | Pepe et al. | 427/389.8 |
| 4,178,412 | 12/1979 | Sage et al. | 428/391 |
| 4,215,161 | 7/1980 | Seibold et al. | 427/389.8 |
| 4,291,095 | 9/1981 | Chase et al. | 428/391 |
| 4,341,674 | 7/1982 | Vermilion et al. | 524/156 |

*Primary Examiner*—Thurman K. Page

*Attorney, Agent, or Firm*—John D. Lister; Cornielus P. Quinn; Gregory A. Evearitt

[57] ABSTRACT

A process for treating a glass fiber mat comprising contacting the surface of a cured mass of glass fibers with at least one latex polymer in such a manner as to thoroughly coat the surface of said cured mass of glass fibers. Preferably, the latex polymer is elastomeric in nature. Also disclosed is a process for making a glass fiber mat as well as a glass mat product produced by the inventive process.

8 Claims, No Drawings

METHOD FOR THE TREATMENT AND PRODUCTION OF GLASS FIBER MATS

This invention relates to a novel process for the treatment of glass fiber mats. It also relates to a novel process for the production of glass fiber mats. Furthermore, this invention relates to improved glass fiber mats produced by the above novel processes.

The production of glass fiber mats is well known in the art. Typically these mats are made by first impregnating the glass fibers with a binder, such as a phenolic resin binder, and then consolidating the glass fibers and heat curable binder into a loosely packed mass. This mass is then passed to an oven where the bonded mass of glass fibers are compressed to a selected thickness and density and then cured. The resulting cured mass is commonly referred to as a glass fiber mat.

In the above described conventional or typical process for the production of glass fiber mats, the glass fibers are sometimes treated with a so-called sizing agent before the glass fibers are bonded together and subsequently cured. A sizing agent is applied to each individual fiber for the purpose of providing each glass fiber with a protective coating.

The above processes and glass fiber mats produced thereby are not without associated problems however. When the sizing agent is applied to each individual fiber before the fibers are bonded together, the bonding agent can alter the chemical nature of the protective coating on the fiber in such a manner so as to at least partially dissipate or even alter the coating's original function. Additionally, during the curing process, more of the sizing agent may "burn off" each individual fiber than anticipated or desired. When one or both of the above mentioned problems occur, the final formed glass fiber mat can lose a certain desired degree of flexibility or ductility due to the predominance of the rather rigid thermosetting binder used over the more flexible sizing agent.

Applicants sought a procedure which would obviate the above described problems associated with the conventional procedure yet would be one which would be economical and efficient to practice resulting in a glass fiber mat product or the like having the desirable properties of flexibility and ductility.

In accordance with one embodiment of the present invention, Applicants have discovered that by contacting a cured glass fiber mass with a latex polymer in such a manner so as to thoroughly coat the surface of the cured glass fiber mass that there is achieved an economical and efficient process which results in a final product of good ductility and flexibility. Applicants' invention avoids the problems caused by coating individual fibers, bonding them together, and subsequently curing them. By treating the mass of the bonded fibers after they are cured it has been qualitatively observed by Applicants that the final product has a high degree of flexibility which is an indication that the latex polymer coating is not affected to any large extent, if any, by the cured binder.

The term "glass fibers" as used herein shall mean continuous fibers formed by rapid attenuation of a multiplicity of streams of molten glass and to strands formed when continuous glass fiber filaments are gathered together in forming. The term shall also mean yards and cords formed by plying and/or twisting a multiplicity of strands together and to woven and non-woven fabrics which are formed of such glass fiber strands, yarns or cords.

The term "glass fibers" shall also apply to discontinuous fibers formed by high pressure steam or air directed onto multiple streams of molten glass and to yarns that are formed when such discontinuous fibers are allowed to rain down onto a surface from which the fibers are gathered together to form a sliver which is drafted into a yarn. The term shall also refer to woven and non-woven fabrics formed of such yarns of discontinuous fibers and to combinations of such continuous and discontinuous fibers in strand, yarn cord and fabric formed therefrom.

As used herein, the term "cured mass of bonded glass fibers" refers to the resulting cured glass fiber mass. Typically, the term is used synonymously with the term glass fiber mat and designates such products having a thickness between about 5–100 mils.

Any commercially available latex polymer may be used in the present invention. The term polymer encompasses homo-, co-, and terpolymers, and the like. Typically, though, the latex polymer will be a copolymer or terpolymer. Whatever polymer is used should be soft and flexible.

Examples of such polymers include but are not limited to butadiene-styrene, butadiene-acrylonitrile, chloroprene, isopropene, neoprene, isobutyl rubber, vinylpyridine containing terpolymers, and acrylic polymers.

One polymer found to be especially useful is an ethylene-vinyl acetate-vinyl chloride terpolymer. This terpolymer imparts not only noticeable flexibility and ductility but also fire resistance properties to the final glass mat.

The latex polymers are conventional in composition and can be non-ionic, cationic, or anionic.

The surface of the glass fiber mat can be contacted with the latex polymer in any manner so as to thoroughly coat the surface of the mat. Typically methods of contact would include dipping and spraying.

In another embodiment of the present invention, a novel process for the production of glass fiber products is provided.

This novel process comprises the steps of (a) combining glass fibers with a heat curable binder composition;
(b) consolidating the fibers and heat curable binder into a loosely packed mass;
(c) curing said consolidated fibers under suitable conditions of time and temperature; and
(d) thereafter contacting the cured mass of glass fibers with a latex polymer in such a manner so as to thoroughly coat the surface of the cured mass of glass fibers with the latex polymer.

Although any heat curable binder compatible with the glass fibers may be utilized in the present invention, the preferred one is a urea-formaldehyde resin. Phenolic based resins may also be utilized.

Also a silane coupling agent may be present in the binder. It is thought that any commercially available silane coupling agent may be used. However, the preferred silanes are aminoalkylsilanes. Certain epoxy silanes may also be utilized.

A catalyst may also be used in the binder utilized in the present invention. Such a catalyst is one which is effective during curing conditions to change the pH of the system to one at which condensation occurs at a relatively rapid rate. A typical binder catalyst utilized is ammonium sulfate.

Other adjuvants such as various filler, pigments, dyes, etc. can be used if desired, but such are not essential for the binder to be effective.

Desirably, the binder composition is applied to the glass fibers in such a way that the binder comprises from about 1.0 to about 40 wt % of the total weight of the glass fiber products.

The binder and fibers are combined in any suitable manner. Typically, the binder is associated with the glass fibers in a forming hood and then they are projected onto a conveyor such as a foraminous conveyor.

The consolidated fibers should be heated for a temperature and time sufficient to remove water and effect curing of the heat settable binder. Preferably the curing is conducted at a temperature in the range of about 300°-600° F. for about 5 seconds-5 minutes, most preferably about 375°-450° F. for about 1-3 minutes.

The surface of the cured product is then contacted with the latex polymer in any suitable manner as disclosed earlier herein.

The resulting latex polymer coated glass fiber product has many commercial utilities such as for use in automotive hood liners.

Reasonable modifications and variations of the foregoing are possible without departing from either the spirit or scope of the present invention.

We claim:

1. A process for the preparation of a glass fiber product comprising the steps of:

(a) combining the glass fibers with a heat curable binder composition;

(b) consolidating the fibers and heat curable binder into a loosely packed mass;

(c) curing said consolidated fibers under suitable conditions of time and temperature; and (d) thereafter contacting the cured mass of glass fibers with a latex polymer of an ethylene-vinyl acetate-vinyl chloride terpolymer in such a manner so as to thoroughly coat the surface of said cured mass of glass fibers with the latex polymer.

2. A process according to claim 1 wherein said heat curable binder in 1(b) is a urea-formaldehyde resin.

3. A process according to claim 1 wherein the combined glass fibers resulting from 1(a) are projected onto a conveyor before the consolidation in 1(b).

4. A process according to claim 1 wherein the curing in 1(c) is conducted at a temperature of about 300°-600° F. for about 5 seconds-5 minutes.

5. A process according to claim 4 wherein said curing is conducted at a temperature of about 375°-450° F. for about 1-3 minutes.

6. A process according to claim 1 wherein said latex polymer is an elastomeric polymer.

7. A process according to claim 1 wherein said contacting in 1(d) is effected by dipping said cured mass of glass fibers into a solution of said latex polymer.

8. A glass fiber mat produced by the process of claim 1.

* * * * *